US007666009B2

(12) United States Patent
Minich et al.

(10) Patent No.: US 7,666,009 B2
(45) Date of Patent: Feb. 23, 2010

(54) SHARED HOLE ORTHOGONAL FOOTPRINTS

(75) Inventors: Steven E. Minich, York, PA (US); Christopher J. Kolivoski, York, PA (US); Stephen B. Smith, Mechanicsburg, PA (US); Gary J. Oleynick, Encinitas, CA (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 12/206,858

(22) Filed: Sep. 9, 2008

(65) Prior Publication Data

US 2009/0203238 A1 Aug. 13, 2009

Related U.S. Application Data

(60) Provisional application No. 61/027,182, filed on Feb. 8, 2008.

(51) Int. Cl.
*H01R 4/66* (2006.01)

(52) U.S. Cl. ..... 439/101; 439/941

(58) Field of Classification Search ..... 439/101, 439/108, 607.05, 607.07, 607.08, 607.09, 439/941

See application file for complete search history.

(56) References Cited

U.S. PATENT DOCUMENTS 6,343,955 B2 * 2/2002 Billman et al. ..... 439/607.48
6,464,541 B1 10/2002 Hashim et al.
6,641,411 B1 * 11/2003 Stoddard et al. ..... 439/108
6,908,340 B1 6/2005 Shafer
6,913,490 B2 * 7/2005 Whiteman et al. ..... 439/607.05
6,948,951 B2 9/2005 Wu et al.
6,988,902 B2 1/2006 Winings
7,331,802 B2 * 2/2008 Rothermel et al. ..... 439/108
7,500,871 B2 * 3/2009 Minich et al. ..... 439/544
7,544,096 B2 * 6/2009 Cohen et al. ..... 439/607.05
2004/0094328 A1 5/2004 Fjelstad et al.
2007/0207641 A1 9/2007 Minich
2008/0233806 A1 9/2008 Rothermel et al.

OTHER PUBLICATIONS

PCT International Search Report and Written Opinion, dated Jul. 14, 2009, for PCT/US2009/032941, filed Feb. 3, 2009.

* cited by examiner

*Primary Examiner*—Thanh-Tam T Le
(74) *Attorney, Agent, or Firm*—Woodcock Washburn LLP

(57) ABSTRACT

Disclosed are an electrical connector and a method for providing transmit and receive electrical signal contacts to reduce or minimize total crosstalk. Such methods may be particularly suitable for connectors having larger near-end crosstalk aggressors than far-end crosstalk aggressors. The electrical signal contacts may be subdivided on a substrate, such as a midplane PCB, and through the opposing connectors, such that the transmitting contacts are all on one side of the connector and the receiving contacts are on the other side of the connector, with a buffer between them. The buffer may comprise a plurality of "dummy" or "buffer" contacts, which may be unassigned or devoid of electrical connectivity. This is one step beyond the primary assignment of contacts as single-ended or differential signal contacts. The contacts themselves may also receive a secondary assignment according to their desired transmitting, receiving, or buffering function.

16 Claims, 2 Drawing Sheets

SHARED HOLE ORTHOGONAL FOOTPRINTS

CROSS-REFERENCE TO RELATED APPLICATIONS

This application claims benefit under 35 U.S.C. §119(e) of provisional U.S. patent application No. 61/027,182, filed Feb. 8, 2008, the contents of which are incorporated herein by reference in their entirety.

FIELD OF THE INVENTION

Generally, the invention relates to electrical connectors. More particularly, the invention relates to assigning transmit and receive signal pairs to reduce or minimize total crosstalk.

BACKGROUND OF THE INVENTION

Undesirable electrical signal interference between differential signal pairs of electrical contacts (i.e., crosstalk) increases as signal density increases, particularly in electrical connectors that are devoid of metallic crosstalk shields. Additionally, near-end crosstalk, which may be higher in the connector than far-end crosstalk, may negatively affect the signal integrity of the connector by affecting the far-end crosstalk of the connector.

Therefore, there is a need to reduce the affects of crosstalk, such as near-end crosstalk, on far-end crosstalk and on the total crosstalk of electrical connectors.

SUMMARY OF THE INVENTION

The attached figures provide a method for providing transmit (TX) and receive (RX) pairs to reduce or minimize total crosstalk. Such methods may be particularly suitable for connectors having larger near-end crosstalk (NEXT) aggressors than far-end crosstalk (FEXT) aggressors. For link performance per IEEE 802.3ap, a lower total FEXT may be more important than a lower NEXT.

The differential signal pairs may be subdivided on the PCB and through the connector, such that the transmitting pairs are all on one side and the receiving pairs are on the other side, with a buffer between them. The buffer may comprise non-signal pins, such as a plurality of "dummies" or "buffers". The dummies may be unassigned, lack electrical connectivity, be assigned to ground, terminated to resistors, or be assigned to power. This is one step beyond the assignment of contacts as single-ended or differential signals. The pairs themselves may also be grouped together according to function. This effectively negates near-end crosstalk, which is generally higher than far-end crosstalk. Near-end crosstalk is negated because all of the signals in the aggressor pairs are going the same direction as the signals in the victim pairs. Therefore, only far-end crosstalk needs to be considered.

An electrical connector defining a mating interface and a mounting interface is disclosed, comprising a set of differential signal contact pairs and a first linear array of contacts, the first linear array at least partially bisecting the set of differential signal contact pairs into a first subset and a second subset such that, at least at the mating interface, the first subset is located on a first side of the first linear array and the second subset is located on a second side opposite the first side of the first linear array, wherein each differential signal contact pair of the first subset is adapted to transmit signals in a first direction from the mating interface to the mounting interface.

The electrical connector may further be devoid of any contact of the first subset being adjacent to any contact of the second subset. The electrical connector may further include the first linear array of contacts being adapted to be devoid of any electrical connection to the substrate. The electrical connector may further include each contact of the first linear array of contacts being adapted to be a ground contact. The electrical connector may further include a differential signal contact pair of the first subset being surrounded by a plurality of differential signal contact pairs of the first subset. The electrical connector may further include each differential signal contact pair of the second subset being assigned to transmit signals in a second direction opposite the first direction. The electrical connector may further comprise a third subset of contacts on the first side of the first linear array, each differential signal contact pair of the third subset being adapted to receive signals in a second direction from the mounting interface to the mating interface, wherein the first and third subsets form a fourth subset, and wherein at least eighty percent of the differential signal pairs of the fourth subset are located within the first subset.

An electrical connector is disclosed, comprising a first set of electrical contacts, a second set of electrical contacts, and a third set of electrical contacts adjacent to the first and second sets, wherein each contact of the first set and the second set defines a mating interface and a mounting interface, the first set is adapted to transmit signals in a first direction from the mating interface towards the mounting interface, the second set is adapted to transmit signals in a second direction opposite the first direction, and the electrical connector is devoid of any contact of the first set being adjacent to any contact of the second set.

The electrical connector may further include at least on contact of the third set being adapted to be devoid of electrical connection with the substrate. The electrical connector may further include at least one contact of the third set being a ground contact. The electrical connector may further include a first and a second contact of the first set forming a first differential signal contact pair, and wherein the first differential signal contact pair is surrounded by a plurality of differential signal contact pairs of the first set. The electrical connector may further include the third set of electrical contacts defining a first linear array extending along a third direction, and wherein at least one contact of the first set is adjacent to a contact of the first linear array along the third direction.

A method for improving the performance of an electrical connector is disclosed, comprising the steps of providing a first subset of a set of electrical contacts in the connector to transmit from a first interface of the connector to a second interface of the connector, the first subset comprising a first victim differential signal contact pair that is surrounded by a first plurality of aggressor differential signal contact pairs, providing a second subset of the set of electrical contacts to transmit from the second interface to the first interface, the second subset comprising a second victim differential signal contact pair that is surrounded by a second plurality of aggressor differential signal contact pairs, and negating near-end cross-talk by transmitting differential signals in the first plurality of aggressor differential signal contact pairs in the first subset in the same direction as the first victim differential contact pair in the first subset.

The method for improving the performance of an electrical connector may further comprise the step of providing a third subset of the set of electrical contacts, the third subset forming an array of contacts adjacent to the first subset and the second subset, such that the electrical connector is devoid of adjacency of any contact that surrounds the first differential signal contact pair to any contact that surrounds the second differential signal contact pair.

DETAILED DESCRIPTION OF ILLUSTRATIVE EMBODIMENTS

Figure 1:
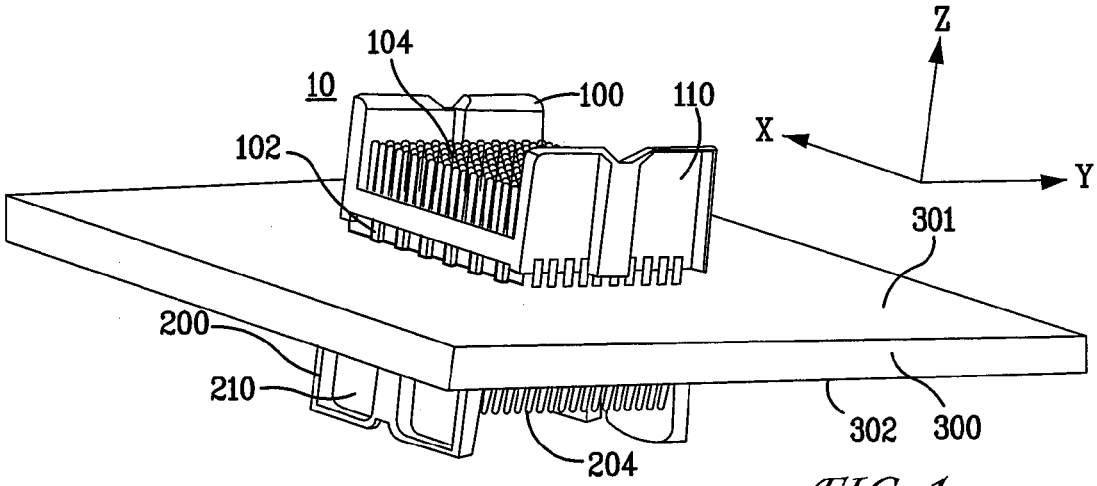
FIG. 1 is a perspective view of two example orthogonal connectors mounted orthogonally to one another through the use of shared apertures in a midplane.

FIG. 1 is a perspective view of two example orthogonal connectors mounted orthogonally to one another through the use of shared apertures in a midplane. Referring to FIG. 1, an example electrical connector system 10 includes a first electrical connector 100, a second electrical connector 200, and a midplane 300. The first electrical connector 100 defines a mounting interface 102 (for example, for electrical connection to a substrate or any electrical device) and a mating interface 104 (for example, for electrical connection to another electrical connector or any electrical device) and includes a leadframe housing 110. The second electrical connector 200 defines a mounting interface 202 (as shown in FIG. 2B) (for example, for electrical connection to a substrate or any electrical device) and a mating interface 204 (for example, for electrical connection to another electrical connector or any electrical device) and includes a leadframe housing 210. The midplane 300 defines a first side 301 and a second side 302.

In the embodiment shown in FIG. 1, the first electrical connector 100 and the second electrical connector 200 are mounted orthogonally (e.g., the connector 100 is rotated ninety degrees (90°) with respect to the connector 200) to one another through the use of the shared pattern of apertures in the midplane 300. As shown in FIG. 1, the midplane 300 lies in a plane defined by the arrows designated X and Y (the coordinate system shown in FIG. 1 remains the same for FIGS. 1-3B). Of course the electrical connector 100 in other embodiments may be connected at either or both of its two interfaces (102 and 104) to electrical devices other than the midplane 300 and the electrical connector 200, and the electrical connector 200 in other embodiments may be connected at either or both of its two interfaces (202 and 204) to electrical devices other than the midplane 300 and the electrical connector 100.

The first electrical connector 100 is mounted on the first side 301 of the midplane 300, extending away from the midplane 300 in the positive direction indicated by the arrow Z of FIG. 1. When first electrical connector 100 is mounted onto the midplane 300, the mounting interface 102 faces towards the first side 301, while the mating interface 104 (typically used to mate with other connectors or any electrical device, not shown) faces away from the first side 301, in the positive Z direction. The second electrical connector 200 is mounted on the second side 302 of the midplane 300, extending away from the midplane 300 in the negative Z direction, relative to the first electrical connector 100. When the second electrical connector 200 is mounted onto the midplane 300, the mounting interface 202 faces towards the second side 302, while the mating interface 204 (typically used to mate with other connectors or any electrical device, not shown) faces away from the second side 302, in the negative Z direction.

In this embodiment, the first electrical connector 100 and the second electrical connector 200 are mounted orthogonally to one another, but this orientation is not required. In other embodiments, the connectors 100 and 200 may be mounted non-orthogonally (e.g., the connector 100 not rotated with respect to the connector 200). Whether the relative mounting of the connectors 100 and 200 is orthogonal or non-orthogonal will depend on the technical requirements or customer needs of the electrical connector system 10.

Figure 2A:
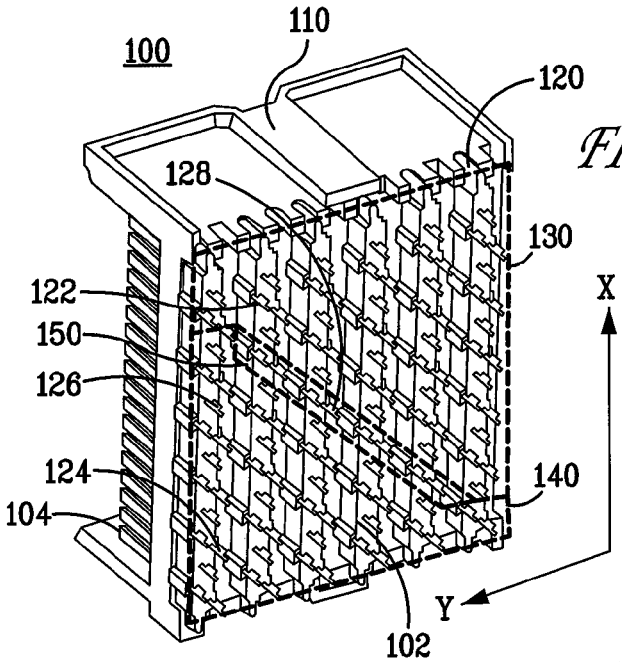
FIG. 2A is a perspective view of the mounting interface of one of the orthogonal connectors depicted in FIG. 1, also showing an example assignment of groups of contacts as transmitting pairs, receiving pairs, and "dummy" or "buffer" pairs.
Figure 2B:
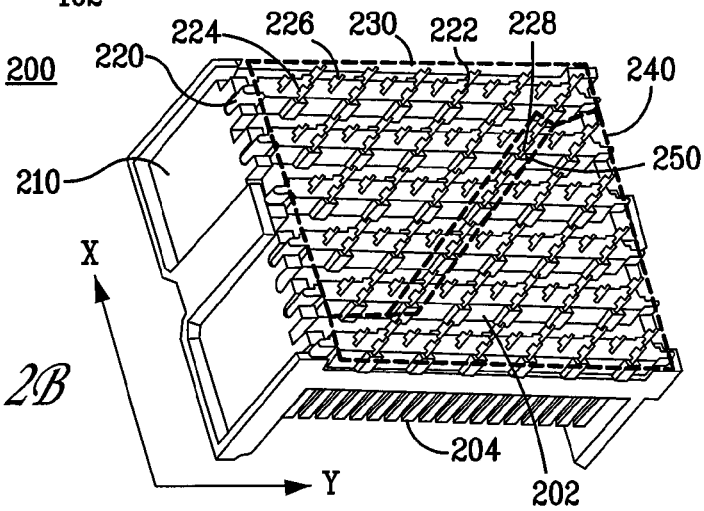
FIG. 2B is a perspective view of the mounting interface of the other orthogonal connector depicted in FIG. 1, in an orientation such that the connector is oriented to mount orthogonally to the example connector depicted in FIG. 2A through the use of shared apertures in a midplane.

FIG. 2A is a perspective view of the mounting interface of one of the orthogonal connectors depicted in FIG. 1, also showing an example assignment of groups of contacts as transmitting pairs, receiving pairs, and "dummy," "buffer," or shielding pins that may be assigned to ground. Referring to FIG. 2A, the first electrical connector 100 includes leadframe assemblies 120, each of which is positioned within the leadframe housing 110. Each leadframe assembly 120 extends in the direction indicated by the arrow X and includes contacts 122. Of course, the designation of the direction of the leadframe assemblies 120 is arbitrary. Each set of contacts 122 included in each leadframe assembly 120 optionally includes differential signal pair contacts 124, ground contacts 126, and unassigned or ground contacts 128. Each of the contacts 122, whether assigned or provided to have a primary assignment as (or primarily provided or adapted to be) a differential signal pair contact 124, a ground contact 126, or an unassigned or ground contact 128, also receives a secondary assignment as (or is secondarily provided or adapted to be) a "transmitting" contact 130, a "receiving" contact 140, or a "buffer" contact 150.

A contact referred to as a transmitting contact 130 conducts signals from the mating interface 104 to the mounting interface 102 of the connector 100. A contact referred to as a receiving contact 140 conducts signals from the mounting interface 102 to the mating interface 104 of the connector 100. Thus, the terms transmitting and receiving are relative terms, so they may be interchanged in other embodiments.

In the embodiment shown in FIG. 2A, the buffer contacts 150 generally separate the transmitting contacts 130 from the receiving contacts 140. In this embodiment, the buffer contacts 150 comprise contacts (which may serve as differential signal pair contacts in other applications of the connector 100) located along a diagonal direction in the center of the connector 100. In one embodiment, the buffer contacts 150 may be devoid of electrical connection with the substrate (e.g., a midplane PCB). In alternative embodiments, the buffer contacts 150 may be ground contacts or may be terminated to one or more resistors.

In the embodiment shown in FIG. 2A, for example, the buffer contacts 150 bisect the remaining contacts 122 into two sets or subsets, comprising the transmitting contacts 130 and the receiving contacts 140, each set or subset (i.e., transmitting contacts 130 and receiving contacts 140) located on a respective half of the connector 100. The buffer contacts 150 do not need to completely separate the transmitting contacts 130 from the receiving contacts 140 to achieve the buffer function. In the embodiment shown in FIG. 2A, for example, the generally linear array of the buffer contacts 150 extends in a first diagonal direction in the center of the connector 100. Some of the transmitting contacts 130 are adjacent to some of the buffer contacts 150 along the first diagonal direction, and some of the receiving contacts 140 are adjacent to some of the buffer contacts 150 along the direction opposite the first diagonal direction. In this embodiment, some of the transmitting contacts 130 at both ends of the generally linear array of the buffer contacts 150 are adjacent to some of the receiving contacts 140. Also, some of the receiving contacts 140 at both ends of the generally linear array of the buffer contacts 150 are adjacent to some of the transmitting contacts 130. In other embodiments (not shown), some of the transmitting contacts 130 may be adjacent to some of the buffer contacts 150 along the first diagonal direction at both ends of the generally linear array of the buffer contacts 150, or some of the receiving contacts 140 may be adjacent to some of the buffer contacts 150 along the first diagonal direction at both ends of the generally linear array of the buffer contacts 150.

In another example embodiment (not shown), the buffer contacts 150 may completely separate the transmitting contacts 130 from the receiving contacts 140, so that no transmitting contact 130 is adjacent to a receiving contact 140. The inventors theorize that this configuration of buffer contacts 150 that may completely separate the transmitting contacts 130 from the receiving contacts 140 may further reduce crosstalk between the transmitting contacts 130 and the receiving contacts 140, but this design alternative may also reduce the number of contacts 122 that are available for use as transmitting contacts 130 and receiving contacts 140 to carry signals through the electrical connector system 10.

In another example embodiment (not shown), the buffer contacts 150 generally separate the transmitting contacts 130 from the receiving contacts 140. However, some transmitting contacts 130 that are not adjacent to the buffer contacts 150 may be adjacent to some receiving contacts 140, and some receiving contacts 140 that are not adjacent to the buffer contacts 150 may be adjacent to some transmitting contacts 130. In one embodiment, at least eighty percent of a first subset of pairs of differential signal pair contacts 124 on a first side of the buffer contacts 150 (which may be arranged in a linear array) may be transmitting contacts 130, while the remaining differential signal pair contacts 124 on the first side are receiving contacts 140. In another embodiment, at least eighty percent of a first subset of pairs of differential signal pair contacts 124 on a first side of the buffer contacts 150 (which may be arranged in a linear array) may be receiving contacts 140, while the remaining differential signal pair contacts 124 on the first side are transmitting contacts 130. In such embodiments, a first subset of pairs of differential signal pair contacts 124 on a first side of the buffer contacts 150 may include any other percentage of transmitting contacts 130 and receiving contacts 140, including 90% transmitting contacts 130 or receiving contacts 140, 70% transmitting contacts 130 or receiving contacts 140, 60% transmitting contacts 130 or receiving contacts 140, or 51% transmitting contacts 130 or receiving contacts 140.

FIG. 2B is a perspective view of the mounting interface of the other orthogonal connector depicted in FIG. 1, in an orientation such that the connector is oriented to mount orthogonally to the example connector depicted in FIG. 2A through the use of shared apertures in a midplane. Referring to FIG. 2B, the second electrical connector 200 includes leadframe assemblies 220, each of which is positioned within a leadframe housing 210. Each leadframe assembly 220 extends in the direction indicated by the arrow Y and includes contacts 222. Of course, the designation of the direction of the leadframe assemblies 220 is arbitrary. Each set of contacts 222 optionally includes differential signal pair contacts 224, ground contacts 226, and unassigned or ground contacts 228. Each of the contacts 222, whether assigned or provided to have a primary assignment as (or primarily provided or adapted to be) a differential signal pair contact 224, a ground contact 226, or an unassigned or ground contact 228, also receives a secondary assignment as (or is secondarily provided or adapted to be) a "transmitting" contact 230, a "receiving" contact 240, or a "buffer" contact 250.

A contact referred to as a transmitting contact 230 conducts signals from the mounting interface 202 to the mating interface 204 of the connector 200. Transmitting signals travel through the contacts 222 (mounting interface to mating interface) in an opposite direction compared to how transmitting signals travel through the contacts 122 (mating interface to mounting interface). Transmitting signals are defined in this way such that a transmitting signal passes all of the way through the electrical connector system 10 (starting at the mating interface 104 of the connector 100 and ending at the mating interface 204 of the connector 200) in the negative Z direction. A contact referred to as a receiving contact 240 conducts signals from the mating interface 204 to the mounting interface 202 of the connector 200. Thus, the terms transmitting and receiving are relative terms, so they may be interchanged in other embodiments.

In the embodiment shown in FIG. 2B, the buffer contacts 250 generally separate the transmitting contacts 230 from the receiving contacts 240. In this embodiment, the buffer contacts 250 comprise contacts (which may serve as differential signal pair contacts in other applications of the connector 200) located along a diagonal direction in the center of the connector 200. In one embodiment, the buffer contacts 250 may be devoid of electrical connection with the substrate (e.g., a midplane PCB). In alternative embodiments, the buffer contacts 250 may be ground contacts or may be terminated to one or more resistors.

In the embodiment shown in FIG. 2B, for example, the buffer contacts 250 bisect the remaining contacts 222 into two sets or subsets, comprising the transmitting contacts 230 and the receiving contacts 240, each set or subset (i.e., transmitting contacts 230 and receiving contacts 240) located on a respective half of the connector 200. The buffer contacts 250 do not need to completely separate the transmitting contacts 230 from the receiving contacts 240 to achieve the buffer function. In the embodiment shown in FIG. 2B, for example, the generally linear array of the buffer contacts 250 extends in a first diagonal direction in the center of the connector 200. Some of the transmitting contacts 230 are adjacent to some of the buffer contacts 250 along the first diagonal direction, and some of the receiving contacts 240 are adjacent to some of the buffer contacts 250 along the direction opposite the first diagonal direction. In this embodiment, some of the transmitting contacts 230 at both ends of the generally linear array of the buffer contacts 250 are adjacent to some of the receiving contacts 240. Also, some of the receiving contacts 240 at both ends of the generally linear array of the buffer contacts 250 are adjacent to some of the transmitting contacts 230. In other embodiments (not shown), some of the transmitting contacts 230 may be adjacent to some of the buffer contacts 250 along the first diagonal direction at both ends of the generally linear array of the buffer contacts 250, or some of the receiving contacts 240 may be adjacent to some of the buffer contacts 250 along the first diagonal direction at both ends of the generally linear array of the buffer contacts 250.

In another example embodiment (not shown), the buffer contacts 250 may completely separate the transmitting contacts 230 from the receiving contacts 240, so that no transmitting contact 230 is adjacent to a receiving contact 240. The inventors theorize that this configuration of buffer contacts 250 that may completely separate the transmitting contacts 230 from the receiving contacts 240 may further reduce crosstalk between the transmitting contacts 230 and the receiving contacts 240, but this design alternative may also reduce the number of contacts 222 that are available for use as transmitting contacts 230 and receiving contacts 240 to carry signals through the electrical connector system 10.

In another example embodiment (not shown), the buffer contacts 250 generally separate the transmitting contacts 230 from the receiving contacts 240. However, some transmitting contacts 230 that are not adjacent to the buffer contacts 250 may be adjacent to some receiving contacts 240, and some receiving contacts 240 that are not adjacent to the buffer contacts 250 may be adjacent to some transmitting contacts 230. In one embodiment, at least eighty percent of a first subset of pairs of differential signal pair contacts 224 on a first side of the buffer contacts 250 (which may be arranged in a linear array) may be transmitting contacts 230, while the remaining differential signal pair contacts 224 on the first side are receiving contacts 240. In another embodiment, at least eighty percent of a first subset of pairs of differential signal pair contacts 224 on a first side of the buffer contacts 250 (which may be arranged in a linear array) may be receiving contacts 240, while the remaining differential signal pair contacts 224 on the first side are transmitting contacts 230. In such embodiments, a first subset of pairs of differential signal pair contacts 224 on a first side of the buffer contacts 250 may include any other percentage of transmitting contacts 230 and receiving contacts 240, including 90% transmitting contacts 230 or receiving contacts 240, 70% transmitting contacts 230 or receiving contacts 240, 60% transmitting contacts 230 or receiving contacts 240, or 51% transmitting contacts 230 or receiving contacts 240.

The secondary assignments (or adaptations) of the contacts 122 and 222 as transmitting contacts 130 and 230, receiving contacts 140 and 240, or buffer contacts 150 and 250, in the configuration shown in FIGS. 2A and 2B, have been shown to reduce the total crosstalk in electrical connector system 10. The buffer contacts 150 and 250 allow for an electrical shielding effect between the respective transmitting contacts 130 and 230 and the respective receiving contacts 140 and 240, thereby reducing the undesirable electrical signal interference (crosstalk) between the transmitting contacts 130 and 230 and the respective receiving contacts 140 and 240. This shielding effect may be particularly useful in electrical connectors that are devoid of metallic crosstalk shields.

This shielding effect effectively negates near-end crosstalk, which is generally higher than far-end crosstalk. Near-end crosstalk may partially result from aggressor pairs of differential signal pair contacts 124 or 224 (which may include transmitting contacts 130 or 230 or receiving contacts 140 or 240) negatively impacting the signal integrity characteristics of a victim pair of differential signal pair contacts 124 or 224 (which may include transmitting contacts 130 or 230 or receiving contacts 140 or 240).

In the embodiment shown in FIGS. 2A and 2B, near-end crosstalk is effectively negated because all of the signals in the aggressor contact pairs (which may include transmitting contacts 130 or 230 or receiving contacts 140 or 240) are going the same direction as the signals in the victim contact pairs (which may include transmitting contacts 130 or 230 or receiving contacts 140 or 240). Therefore, only far-end crosstalk needs to be considered when designing an electrical connector system 10.

In the embodiment shown in FIGS. 2A and 2B, at the corners of connector 100 or 200 adjacent to each end of the buffer contacts 150 or 250, there are four pairs of differential signal pair contacts 124 or 224 (three pairs of differential signal pair contacts 124 or 224 are transmitting contacts 130 or 230 and one pair of differential signal pair contacts 124 or 224 are receiving contacts 140 or 240 at one end of the buffer, and three pairs of differential signal pair contacts 124 or 224 are receiving contacts 140 or 240 and one pair of differential signal pair contacts 124 or 224 are transmitting contacts 130 or 230 at the other end of the buffer). Essentially, each of the pairs of differential signal pair contacts 124 or 224 located at the corners of the connectors 100 or 200 adjacent to each end of the buffer contacts 150 or 250 only sees three aggressor contact pairs (which may include transmitting contacts 130 or 230 or receiving contacts 140 or 240). Since crosstalk is a function of the total number of aggressor contact pairs, crosstalk on any of these pairs of differential signal pair contacts 124 or 224 located at the corners of the connectors 100 or 200 adjacent to each end of the buffer contacts 150 or 250 is lower than if there were six, seven, eight, nine, or ten aggressor contact pairs.

Although in the embodiment shown in FIGS. 2A and 2B, the buffer contacts 150 and 250 generally form diagonal linear arrays, this is not necessary to achieve the "buffer" function. In other embodiments, the buffer contacts 150 and 250 may be arranged in horizontal or vertical linear arrays, in the X-Y plane shown in FIGS. 2A and 2B, or the buffer contacts 150 and 250 may be arranged in any other configuration that allows for general separation of the transmitting contacts 130 and 230 from the receiving contacts 140 and 240. Nor is it necessary to limit each connector 100 and 200 to only having a single array of respective buffer contacts 150 and 250. There may be multiple arrays of respective buffer contacts 150 and 250, for example, arranged in two separate linear arrays on each respective connector 100 and 200, or any other multiple-array structure that helps to separate the transmitting contacts 130 and 230 from the respective receiving contacts 140 and 240.

In this embodiment, the first electrical connector 100 and the second electrical connector 200 contain the same number of leadframe assemblies 120 and 220, and the same number of contacts 122 and 222, but this similarity in the design of connectors 100 and 200 is not required. In other embodiments, the connectors 100 and 200 may contain different numbers of leadframe assemblies 120 and 220, and the connectors 100 and 200 may contain different numbers of contacts 122 and 222. The relative numbers of leadframe assemblies 120 and 220 and contacts 122 and 222 contained within the connectors 100 and 200 will depend on the technical requirements or customer needs of electrical connector system 10.

In embodiments where there are different numbers of contacts 122 and 222 on respective connectors 100 and 200, there may still be equal numbers of respective transmitting contacts 130 and 230, respective receiving contacts 140 and 240, and respective buffer contacts 150 and 250, that are used to mount orthogonally to one another on opposite sides of the midplane 300, including a buffering functionality. However, in these embodiments with unequal numbers of contacts 122 and 222, there may be excess contacts 122 or 222 from either or both connectors 100 and 200, which are not used to transmit or receive signals all the way through the electrical connector system 10 (from the mating interface 104 of connector 100, through the midplane 300, and to the mating interface 204 of the connector 200, or in the opposite direction). Instead, the excess contacts 122 on the connector 100 may be devoid of electrical connection to any contact 222 of the connector 200, and/or the excess contacts 222 on connector 200 may be devoid of electrical connection to any contact 122 of the connector 100. The contacts 122 or 222 that are devoid of electrical connection to the other respective connector 200 or 100 may instead be electrically connected to signal traces (not shown) on the respective first side 301 or second side 302 of the midplane 300.

Figure 3A:
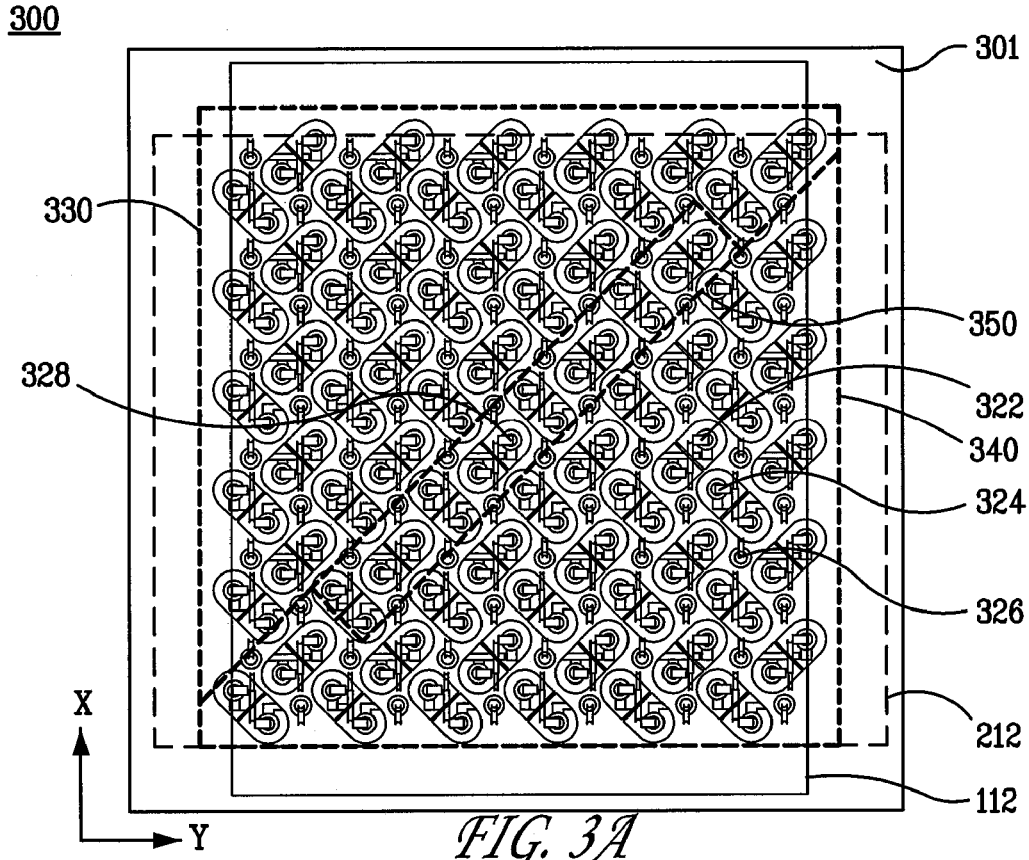
FIG. 3A is an aperture footprint of a midplane for receiving the contact tails of the connector depicted in FIG. 2A (the outline of which is shown in solid line) mounted to the first side of the midplane, also showing an example assignment of groups of contacts as transmitting pairs, receiving pairs, and "dummy" or "buffer" pairs.

FIG. 3A is an aperture footprint of a midplane for receiving corresponding contact tails of the connector depicted in FIG. 2A (the outline of which is shown in solid line) mounted to the first side of the midplane, also showing an example assignment (or adaptation) of groups of contacts as transmitting pairs, receiving pairs, and "dummy" or "buffer" pairs. Referring to FIG. 3A, the first side 301 of the midplane 300 is shown, viewed in the X-Y plane, as defined by the coordinate axis arrows shown in FIG. 1A. The first side 301 is the side that is adapted to mate with the first electrical connector 100. The solid line 112 represents the outside boundaries in the X-Y plane of the leadframe housing 110 of the connector 100, and the dashed line 212 represents the outside boundaries in the X-Y plane of the leadframe housing 210 of the connector 200. The midplane 300 further defines apertures 322 that extend from the first side 301 to the second side 302. The set of apertures 322 included in the midplane 300 optionally includes differential signal pair apertures 324, ground apertures 326, and unassigned or ground apertures 328. In this embodiment, each of the apertures 322, whether assigned or provided to have a primary assignment as (or primarily provided or adapted to be) a differential signal pair aperture 324, ground aperture 326, or unassigned or ground aperture 328, also receives a secondary assignment as (or is secondarily provided or adapted to be) a "transmitting" aperture 330, a "receiving" aperture 340, or a "buffer" aperture 350.

In this embodiment, at the first side 301 of the midplane 300, each aperture 322 is adapted to receive a contact 122 from the connector 100 (shown in FIG. 2A). Also, within the set of apertures 322, each differential signal pair aperture 324, ground aperture 326, and unassigned or ground aperture 328 is adapted to receive a respective differential signal pair contact 124, ground contact 126, and unassigned or ground contact 128 at the first side 301 of the midplane 300. Further, within the set of aperture 322, each aperture that has received a secondary assignment as a transmitting aperture 330, a receiving aperture 340, or a buffer aperture 350 is adapted to receive a respective transmitting contact 130, a receiving contact 140, or a buffer contact 150 at the first side 301 of the midplane 300.

Figure 3B:
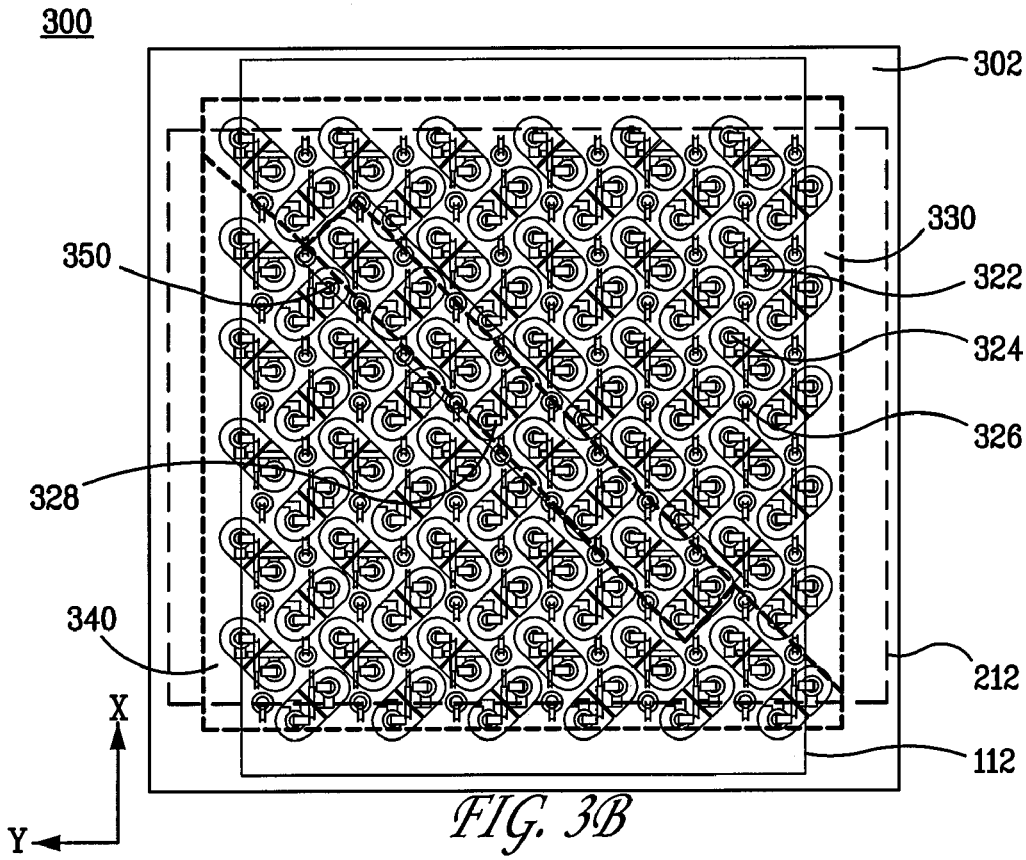
FIG. 3B is the aperture footprint depicted in FIG. 3A, as viewed from the second side of the midplane, to show how the orthogonal connector depicted in FIG. 2B (the outline of which is shown in dashed line) would be mounted to the second side of the midplane.

FIG. 3B is the aperture footprint depicted in FIG. 3A, as viewed from the second side of the midplane, to show how the orthogonal connector depicted in FIG. 2B (the outline of which is shown in dashed line) would be mounted to the second side of the midplane. Referring to FIG. 3B, the second side 302 of the midplane 300 is shown, viewed in the X-Y plane, as defined by the coordinate axis arrows shown in FIG. 1A. The second side 302 is the side that is adapted to mate with the second electrical connector 200. The solid line 112 represents the outside boundaries in the X-Y plane of the leadframe housing 110 of the connector 100, and the dashed line 212 represents the outside boundaries in the X-Y plane of the leadframe housing 210 of the connector 200.

In this embodiment, at the second side 302 of the midplane 300, each aperture 322 is adapted to receive a contact 222 from the connector 200 (shown in FIG. 2B). Also, within the set of apertures 322, each differential signal pair aperture 324, ground aperture 326, and unassigned or ground aperture 328 is adapted to receive a respective differential signal pair contact 224, ground contact 226, and unassigned or ground contact 228 at the second side 302 of the midplane 300. Further, within the set of apertures 322, each aperture that has received a secondary assignment as a transmitting aperture 330, a receiving aperture 340, or a buffer aperture 350 is adapted to receive a respective transmitting contact 230, a receiving contact 240, or a buffer contact 250 at the second side 302 of the midplane 300.

In this embodiment, the primary assignments or adaptations (as a differential signal pair aperture 324, a ground aperture 326, or an unassigned or ground aperture 328) and secondary assignments or adaptations (as a transmitting aperture 330, a receiving aperture 340, or a buffer aperture 350) for each aperture 322 is the same in FIG. 3A as in FIG. 3B, although these assignments may be different in other embodiments in which some apertures 322 may be unoccupied at either or both of the first side 301 or the second side 302. In embodiments where some apertures 322 are unoccupied at either or both of the first side 301 or the second side 302, there may be excess contacts 122 or 222 from either or both connectors 100 and 200, which are not used to transmit or receive signals all the way through the electrical connector system 10. Instead, the contacts 122 or 222 that are devoid of electrical connection to the other respective connector 200 or 100 may be electrically connected to signal traces (not shown) on the respective first side 301 or second side 302 of the midplane 300.

In the embodiment shown in FIGS. 3A and 3B, for example, the buffer apertures 350 bisect the remaining apertures 322 into two sets or subsets, comprising the transmitting apertures 330 and the receiving apertures 340, each set or subset (i.e., transmitting apertures 330 and receiving apertures 340) located on a respective half of the midplane 300. The buffer apertures 350 do not need to completely separate the transmitting apertures 330 from the receiving apertures 340 to achieve the buffer function.

In the embodiment shown in FIGS. 3A and 3B, at the corners of the midplane 300 or connector footprint adjacent to each end of the buffer apertures 350, there are four pairs of differential signal pair apertures 324 (three pairs of differential signal pair apertures 324 are transmitting apertures 330 and one pair of differential signal pair apertures 324 are receiving apertures 340 at one end of the buffer, and three pairs of differential signal pair apertures 324 are receiving apertures 340 and one pair of differential signal pair apertures 324 are transmitting apertures 330 at the other end of the buffer). Essentially, each of the pairs of differential signal pair contacts 124 or 224 (which are mated to differential signal pair apertures 324 in the midplane 300) located at the corners of the connectors 100 or 200 adjacent to each end of the buffer contacts 150 or 250 only sees three aggressor contact pairs (which may include transmitting contacts 130 or 230 or receiving contacts 140 or 240). Since crosstalk is a function of the total number of aggressor contact pairs, crosstalk on any of these pairs of differential signal pair contacts 124 or 224 located at the corners of the connectors 100 or 200 adjacent to each end of the buffer contacts 150 or 250 is lower than if there were six, seven, eight, nine, or ten aggressor contact pairs. In the embodiment shown in FIGS. 3A and 3B, for example, there are some transmitting apertures 330 at either end of the generally linear array of the buffer apertures 350 that are adjacent to the receiving apertures 340. There are also some receiving apertures 340 at either end of the generally linear array of the buffer apertures 350 that are adjacent to the transmitting apertures 330.

In another example embodiment (not shown), the buffer apertures 350 may completely separate the transmitting apertures 330 from the receiving apertures 340, so that no transmitting aperture 330 is adjacent to a receiving aperture 340. The inventors theorize that this configuration of buffer apertures 350 (and respective buffer contacts 150 and 250) that may completely separate the transmitting apertures 330 from the receiving apertures 340 may further reduce crosstalk between the transmitting contacts 130 and 230 and the respective receiving contacts 140 and 240, but this design alternative may also reduce the number of contacts 122 and 222 that are available for use as transmitting contacts 130 and 230 and receiving contacts 140 and 240 to carry signals through the electrical connector system 10.

Although a diagonal (about 45 degrees) configuration or buffer zone of buffer apertures 350 (and respective buffer contacts 150 and 250) is shown in FIGS. 3A and 3B, the configuration or buffer zone of buffer apertures 350 could be vertical (about ninety degrees) or horizontal (about 180 degrees). By selecting a diagonal configuration of buffer contacts 150 or 250, the pairs of differential signal pair contacts 124 or 224 that are assigned to be transmitting contacts 130 or 230 located on one side of the buffer contacts 150 or 250 (a first subset) and the pairs of differential signal pair contacts 124 or 224 that are assigned to be receiving contacts 140 or 240 located on the other side of the buffer contacts 150 or 250 (a second subset) are physically electrically separated from one another by the buffer contacts 150 or 250. A diagonal configuration of buffer contacts 150 or 250 or buffer zone is preferred for orthogonal electrical connector systems 10, particularly in applications that do not require all pairs to be used. If a horizontal or vertical configuration or buffer zone of buffer apertures 350 (and respective buffer contacts 150 and 250) is used, and pairs of transmitting contacts 130 or 230 or transmitting apertures 330 are located on one side of the buffer zone of buffer apertures 350 (and respective buffer contacts 150 and 250) and pairs of receiving contacts 140 or 240 or receiving apertures 340 are located on the opposite side of the buffer zone of buffer apertures 350 (and respective buffer contacts 150 and 250), some pairs of transmitting contacts 130 or 230 or transmitting apertures 330 and receiving contacts 140 or 240 or receiving apertures 340 in the direction perpendicular to the configuration of the buffer contacts 150 or 250 or buffer apertures 350 are unshielded between adjacent buffer apertures/contacts.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Further, several advantages have been described that flow from the structure and methods; the present invention is not limited to structure and methods that encompass any or all of these advantages. Those skilled in the relevant art, having the benefit of the teachings of this specification, may effect numerous modifications to the invention as described herein, and changes may be made without departing from the scope and spirit of the invention as defined by the appended claims.

What is claimed:

1. An electrical connector defining a mating interface and a mounting interface, the connector comprising:

a set of differential signal contact pairs; and a first linear array of contacts, the first linear array at least partially dividing the set of differential signal contact pairs such that, at least at the mating interface, a first subset of the differential signal contact pairs is located on a first side of the first linear array and a second subset of the differential signal contact pairs is located on a second side of the first linear array opposite the first side thereof;

wherein each differential signal contact pair of the first subset conducts electrical signals from the mating interface to the mounting interface, and each differential signal contact pair of the second subset conducts electrical signals from the mounting interface to the mating interface.

2. The electrical connector of claim 1, wherein no contact of the first subset is adjacent to any contact of the second subset.

3. The electrical connector of claim 1, wherein each contact of the first linear array of contacts is a dummy contact.

4. The electrical connector of claim 1, wherein each contact of the first linear array of contacts is a ground contact.

5. The electrical connector of claim 1, wherein a first differential signal contact pair of the first subset is surrounded by a plurality of differential signal contact pairs of the first subset.

6. The electrical connector of claim 1, further comprising a third subset of contacts on the first side of the first linear array, wherein each differential signal contact pair of the third subset conducts electrical signals from the mounting interface to the mating interface;

wherein the first and third subsets form a fourth subset; and wherein at least eighty percent of the differential signal pairs of the fourth subset are located within the first subset.

7. An electrical connector defining a mating interface and a mounting interface, the connector comprising:

a first set of electrical contacts, a second set of electrical contacts, and a third set of electrical contacts adjacent to the first and second sets;

wherein each contact of the first set conducts electrical signals from the mating interface to the mounting interface, each contact of the second set conducts electrical signals from the mounting interface to the mating interface, no contact of the third set is a signal contact, and no contact of the first set is adjacent to any contact of the second set.

8. The electrical connector of claim 7, wherein at least one contact of the third set is a dummy contact.

9. The electrical connector of claim 7, wherein at least one contact of the third set is a ground contact.

10. The electrical connector of claim 7, wherein a first and a second contact of the first set form a first differential signal contact pair, and wherein the first differential signal contact pair is surrounded by a plurality of differential signal contact pairs of the first set.

11. The electrical connector of claim 7, wherein the third set of electrical contacts defines a first linear array extending along a first direction, and wherein at least one contact of the first set is adjacent to a contact of the first linear array along the first direction.

12. A method for improving the performance of an electrical connector, the method comprising:

providing a first subset of a set of electrical contacts in the connector that transmit electrical signals from a first interface of the connector to a second interface of the connector, the first subset comprising a first victim differential signal contact pair that is surrounded by a first plurality of aggressor differential signal contact pairs;

providing a second subset of the set of electrical contacts that transmit electrical signals from the second interface to the first interface, the second subset comprising a second victim differential signal contact pair that is surrounded by a second plurality of aggressor differential signal contact pairs; and transmitting differential signals in the first plurality of aggressor differential signal contact pairs in the first subset in the same direction as the first victim differential contact pair in the first subset.

13. The method of claim 12, further comprising providing a third subset of the set of electrical contacts, the third subset forming an array of contacts adjacent to the first subset and the second subset, such that no contact that surrounds the first differential signal contact pair is adjacent to any contact that surrounds the second differential signal contact pair.

14. An electrical connector that defines a mating interface and a mounting interface, the electrical connector comprising:

a first arrangement of electrical contacts that conduct electrical signals from the mating interface to the mounting interface;

a second arrangement of electrical contacts that conduct electrical signals from the mounting interface to the mating interface; and an arrangement of buffer contacts disposed between the first arrangement of electrical contacts and the second arrangement of electrical contacts, wherein the buffer contacts do not conduct electrical signals between the mating and mounting interfaces.

15. The electrical connector of claim 14, wherein each of the first and second arrangements comprises a respective plurality of differential signal pairs of electrical contacts.

16. The electrical connector of claim 15, wherein no contact in the first arrangement is adjacent to any contact in the second arrangement.

* * * * *